US006854352B2

(12) United States Patent
Onodera

(10) Patent No.: US 6,854,352 B2
(45) Date of Patent: Feb. 15, 2005

(54) INPUT APPARATUS WITH ROTARY TYPE ELECTRICAL COMPONENT

(75) Inventor: Mikio Onodera, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 66 days.

(21) Appl. No.: 10/190,379

(22) Filed: Jul. 3, 2002

(65) Prior Publication Data

US 2003/0010517 A1 Jan. 16, 2003

(30) Foreign Application Priority Data

Jul. 5, 2001 (JP) ..... 2001-204860

(51) Int. Cl.[7] ..... H01H 25/04
(52) U.S. Cl. ..... 74/471 XY; 345/161
(58) Field of Search ..... 74/471 XY; 273/148 B; 345/161

(56) References Cited

U.S. PATENT DOCUMENTS 3,870,161 A * 3/1975 Cording ..... 212/289
6,004,134 A * 12/1999 Marcus et al. ..... 434/45
6,104,382 A * 8/2000 Martin et al. ..... 345/161
6,154,198 A * 11/2000 Rosenberg ..... 345/161
6,400,352 B1 * 6/2002 Bruneau et al. ..... 345/156
6,573,885 B1 * 6/2003 McVicar ..... 345/161

FOREIGN PATENT DOCUMENTS

EP 1 069 488 A * 1/2001
GB 2 350 170 A * 11/2000
WO WO 98 33136 A * 7/1998

* cited by examiner

*Primary Examiner*—William C. Joyce
(74) *Attorney, Agent, or Firm*—Brinks Hofer Gilson & Lione

(57) ABSTRACT

In an input apparatus of the invention, since driving levers are made to perform seesaw operations, it is not necessary to perform a rotating operation by an arc shape like a conventional interlocking member, a space in the vertical direction can be made small, and the input apparatus which can be miniaturized in the vertical direction can be provided.

33 Claims, 7 Drawing Sheets

INPUT APPARATUS WITH ROTARY TYPE ELECTRICAL COMPONENT

BACKGROUND OF THE INVENTION

1. Field of the Invention

The present invention relates to an input apparatus used for operation of an air conditioner of an automobile or the like, and particularly suitable for use in something that produces an inner force sense at the time of operation.

2. Description of the Related Art

A structure of a conventional input apparatus will be described on the basis of FIG. 13. A box-shaped frame 51 includes a quadrilateral upper-surface plate 51*a*, a circular hole 51*b* provided in the upper-surface plate 51*a*, and four side walls 51*c* bent downward from four peripheries of the upper-surface plate 51*a*.

First and second interlocking members 52 and 53 made of metal plates respectively include slits 52*a* and 53*a* at center portions, form arc shapes, and in a state where the first interlocking member 52 is housed in the frame 51, both ends thereof are attached to the pair of side walls 51*c* facing each other, and the first interlocking member 52 is rotatable with the attachment portions as fulcrums.

The second interlocking member 53 is housed in the frame 51 in a state where it intersects the first interlocking member 52 at right angles and crosses each other, both end portions thereof are attached to the other pair of side walls 51*c* facing each other, and the second interlocking member 53 is rotatable with the attachment portions as fulcrums.

A linear operating member 54 is inserted in the crossing slits 52*a* and 53*a* of the first and the second interlocking members 52 and 53 to become engageable with the first and the second interlocking members 52 and 53, one end portion protrudes to the outside through the hole 51*b* of the frame 51, the other end is supported by a support member 55 disposed at the lower part of the frame 51, and the operating member 54 can be tilted.

When the operating member 54 protruding from the hole 51*b* is held and the operating member 54 is operated, the operating member 54 performs a tilting operation with a portion supported by the support member 55 as a fulcrum, and in accordance with the tilting operation of this operating member 54, the first and the second interlocking members 52 and 53 in an engaging state with this operating member 54 are rotated.

In a neutral state of the operating member 54, the operating member 54 is in a vertical state with respect to the support member 55, and in this neutral state, when the operating member 54 is tilted in the direction of an arrow A parallel with the slit 52*a*, the second interlocking member 53 is engaged with the operating member 54 and is rotated.

In the neutral state of the operating member 54, when the operating member 54 is tilted in the direction of an arrow B parallel with the slit 53*a*, the first interlocking member 52 engages with the operating member 54 and is rotated, and further, when the operating member 54 is tilted in the direction of an arrow C at an intermediate position between the direction of the arrow A and the direction of the arrow B, both the first and the second interlocking members 52 and 53 are engaged with the operating member 54 and both are rotated.

First and second rotary type electrical components 56 and 57 made of rotary type sensors or the like respectively include main body portions 56*a* and 57*a*, and rotating shafts 56*b* and 57*b* rotatably attached to the main body portions 56*a* and 57*a*.

Then, the first and the second rotary type electrical components 56 and 57 are attached to the support member 55 on the same plane, the rotating shaft 56*b* of the first rotary type electrical component 56 is coupled with one end of the first interlocking member 52 and is rotated in accordance with the rotation of the first interlocking member 52, and by this, the first rotary type electrical component 56 is operated.

Besides, the rotating shaft 57*b* of the second rotary type electrical component 57 is coupled with one end of the second interlocking member 53 and is rotated in accordance with the rotation of the second interlocking member 53, and by this, the second rotary type electrical component 57 is operated.

Then, a tilt position of the operating member 54 is detected by the first and the second rotary type electrical components 56 and 57.

First and second motors 58 and 59 respectively include main body portions 58*a* and 59*a* and rotating shafts 58*b* and 59*b* rotatably attached to the main body portions 58*a* and 59*a*.

Then, the first and the second motors 58 and 59 are attached to the support member 55 on the same plane, the rotating shaft 58*b* of the first motor 58 is coupled with the rotating shaft 56*b* of the first rotary type electrical component 56, and the rotating force of the first motor 58 is transmitted to the rotating shaft 56*b* through the rotating shaft 58*b*, and further, the rotating shaft 59*b* of the second motor 59 is coupled with the rotating shaft 57*b* of the second rotary type electrical component 57, and the rotating force of the second motor 59 is transmitted to the rotating shaft 57*b* through the rotating shaft 59*b*.

Next, the operation of the conventional input apparatus having the structure as set forth above will be described. First, when the operating member 54 is tilted, the first and the second interlocking members 52 and 53 are rotated, and by the rotation of the first and the second interlocking members 52 and 53, the rotating shafts 56*b* and 57*b* are respectively rotated, the first and the second rotary type electrical components 56 and 57 are operated, and a tilt position of the operating member 54 is detected.

At the time of the tilting operation of the operating member 54, signals are transmitted from a control portion (not shown) to the first and the second motors 58 and 59, the first and the second motors 58 and 59 are driven, and the driving forces are transmitted to the rotating shafts 56*b* and 57*b* of the first and the second rotary type electrical components 56 and 57.

Then, the driving forces of the first and the second motors 58 and 59 function as drag (inner force sense or haptic) against the tilting operation of the operating member 54.

In the conventional input apparatus, since the first and the second interlocking members 52 and 53 are arc-shaped and perform the rotation operation, there is a problem that an occupied area of the first and the second interlocking members 52 and 53 in the vertical direction is large, and the size becomes large in the vertical direction.

Besides, since axial directions of the rotating shafts 56*b* and 57*b* of the first and the second rotary type electrical components 56 and 57 and the rotating shafts 58*b* and 59*b* of the first and the second motors 58 and 59 are identical to the direction of extension of the first and the second interlocking members 52 and 53, and they are in a continuous state, there is a problem that an attachment space of the rotary type electrical components 56 and 57 and the motors 58 and 59 in the horizontal direction becomes large, and the size becomes large in the horizontal direction.

Further, the box-shaped frame 51 is required in which the first and the second interlocking members 52 and 53 are rotatably attached in a state where they are housed, and there are problems that the cost becomes high, an occupied space is large, and the size becomes large.

SUMMARY OF THE INVENTION

An object of the invention is therefore to provide a small and inexpensive input apparatus.

First solving means for solving the above problems is made to have a structure which includes a tiltable operating member, a driving body provided to the operating member in an axial line direction, at least one pair of first and second driving levers which can perform a seesaw operation in response to a tilt operation of the operating member and include attachment portions and arm portions coupled with each other, and first and second rotary type electrical components operated by the first and the second driving levers, respectively, wherein the attachment portions of the first and the second driving levers are disposed on a vertical plane orthogonal to the axial line direction and in a state where they are orthogonal to each other, and are respectively coupled with lateral face sides of the driving body in the axial line direction, the arm portions of the first and the second driving levers are disposed in a state where they are orthogonal to each other or are parallel with each other, and are supported in a state where they are disposed in a direction perpendicular to the axial line direction, and at a time of the tilt operation of the operating member, the driving body, together with the operating member, performs a tilt operation to move the attachment portion up and down in the axial line direction, and in accordance with the up and down movement of the attachment portion, each of the arm portions performs a seesaw operation with a shaft support portion as a center, each of end sides of the arm portions positioned at a side opposite to the attachment portion with the shaft support portion between them is moved up and down, and each of the first and the second rotary type electrical components is operated by the movement of the end side of the arm portion.

By this structure, since the driving lever performs the seesaw operation, it is not necessary to perform the rotation operation by the arc shape like the conventional interlocking member, the space in the vertical direction can be made small, and an input apparatus which can be miniaturized in the vertical direction can be provided.

Besides, second solving means is made to have a structure that the driving body includes a first and a second driving bodies, the first and the second driving bodies are respectively rotatably attached to the operating member, and one of the attachment portions of the first and the second driving levers is held by a first shaft portion to each of the first and the second driving bodies.

By this structure, at the time when the first and the second driving bodies are tilted, each of the first and the second driving bodies follows the up and down movement of the driving lever and can be individually rotated, and an input apparatus including the operating member with an excellent tilt operation can be obtained.

Besides, third solving means is made to have a structure that each of the first and the second driving bodies includes a plate-like portion perpendicular to the axial line direction, a hole provided in the plate-like portion to vertically pass through it, and a side plate portion having a flat surface extending in the axial line direction from one end of the plate-like portion to form an L shape, directions of the side plate portions of the first and the second driving bodies are opposite to each other with respect to the axial line direction, they are mutually protruded to the sides of the plate-like portions, and in a state where the plate-like portions are overlapped with each other, the operating member is inserted in each of the holes to couple the operating member and the first and the second driving bodies, and one of the attachment portions of the first and the second driving levers is held by the first shaft portion to each of the side plate portions.

By this structure, attachment of the first and the second driving bodies in the axial direction can be made small, and a small input apparatus can be obtained.

Besides, by merely attaching the attachment portion to the flat surface of the side plate portion of the driving body, the attachment portions of the first and the second driving levers can be attached in the state where they are orthogonal to each other, and a thing excellent in productivity can be obtained.

Besides, fourth solving means is made to have a structure that tooth portions engaging with gears provided in the first and the second rotary type electrical components are provided at the end sides of the first and the second driving levers, each of the arm portions of the first and the second driving levers is supported between the first shaft portion and the tooth portion by a second shaft portion to a support member to which the first and the second driving levers are attached, the first and the second driving levers can perform a seesaw operation with the second shaft portion as a center, and at the time of the tilt operation of the operating member, the first and the second driving levers perform the seesaw operation correspondingly to the tilt operation of the first and the second driving bodies, the gear is rotated by the tooth portion, and the first and the second rotary type electrical components are operated.

By this structure, the driving lever is coupled with the rotary type electrical component through the gear, and it is possible to obtain an input apparatus in which the operation of the rotary type electrical component from the driving lever is certain.

Besides, fifth solving means is made to have a structure that the arm portions of the first and the second driving levers are disposed to cross each other in a state where they intersect each other at right angles.

By this structure, the occupied space of the first and the second driving levers can be made small, and a small input apparatus can be obtained.

Besides, sixth solving means is made to have a structure that the attachment portions of the first and the second driving levers are respectively formed by bending the arm portions perpendicularly.

By this structure, a coupling position of the driving lever at the driving body side can be made far from a second axis, the seesaw operation of the driving lever can be made smooth, and a linear operation of the rotary type electrical component can be performed.

Besides, seventh solving means is made to have a structure that a motor for transmitting an inner force sense to the operating member is disposed correspondingly to each of the first and the second driving levers.

By this structure, an input apparatus in which the inner force sense is produced in the operating member can be provided.

Besides, eighth solving means is made to have a structure that a rotating shaft of the rotary type electrical component and a rotating shaft of the motor are coaxially integrally formed, and the gear is attached to the rotating shaft.

By this structure, the motor and the rotary type electrical component can be coaxially arranged, a space factor is excellent, one rotating shaft suffices, and an inexpensive input apparatus can be obtained.

Besides, ninth solving means is made to have a structure that the motors respectively provided correspondingly to the first and the second driving levers are disposed on a same plane.

By this structure, since the motors are attached on the same plane, an input apparatus having excellent ease of assembly can be obtained.

Besides, tenth solving means is made to have a structure that at least one of the motors is disposed in a state where an axial line of the motor is positioned above or below a position passing a tilt center of the driving body and in a direction perpendicular to the axial line direction.

By this structure, an attachment space of the motor in the horizontal direction can be made small, and a small input apparatus in the horizontal direction can be obtained.

Besides, eleventh solving means is made to have a structure that the motor is disposed in a state where an axial line of the motor is perpendicular to a direction in which the arm extends.

By this structure, as compared with a conventional one, the attachment space of the motor in the horizontal direction can be made small, and a small input apparatus in the horizontal direction can be obtained.

DETAILED DESCRIPTION OF THE PREFERRED EMBODIMENTS

Figure 1:
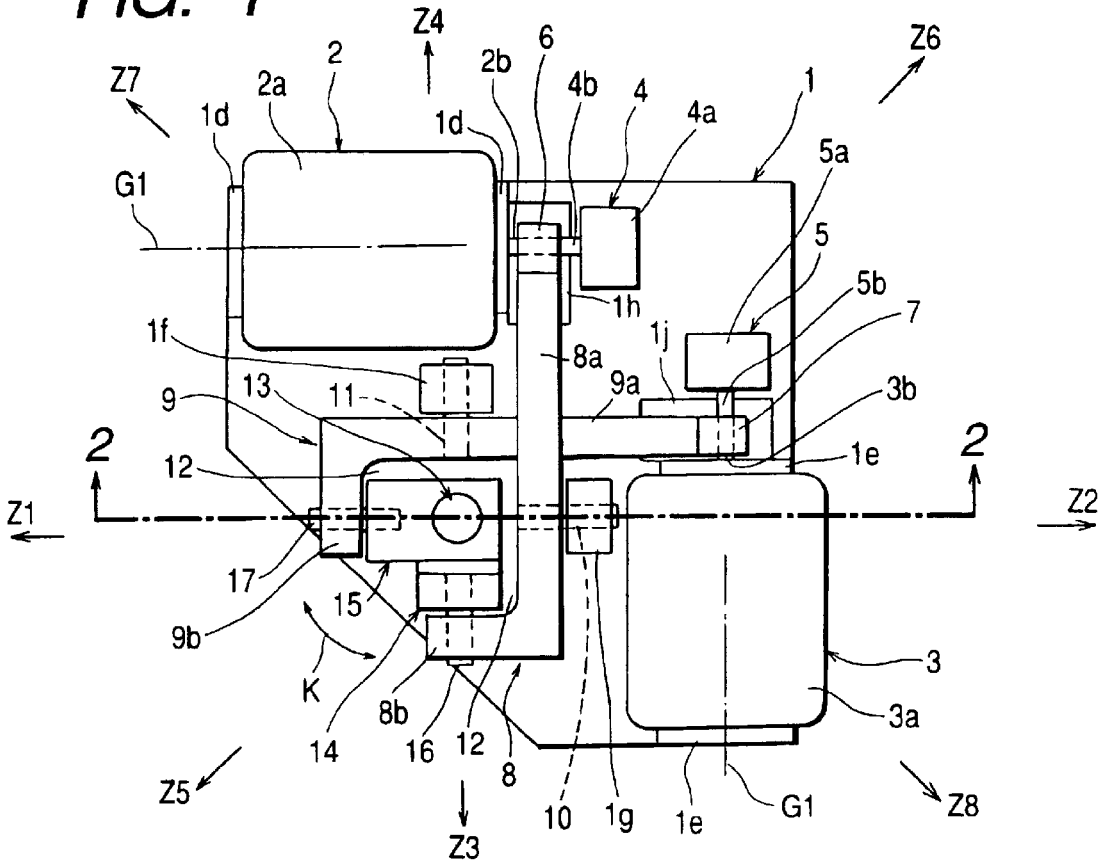
FIG. 1 is a plan view of a first embodiment of an input apparatus of the invention.
Figure 2:
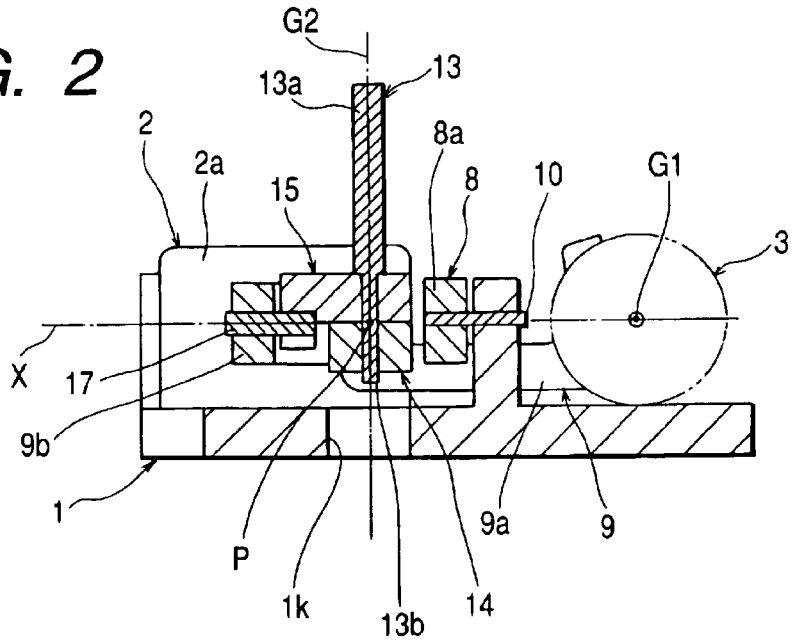
FIG. 2 is a sectional view along line 2—2 of FIG. 1.
Figure 3:
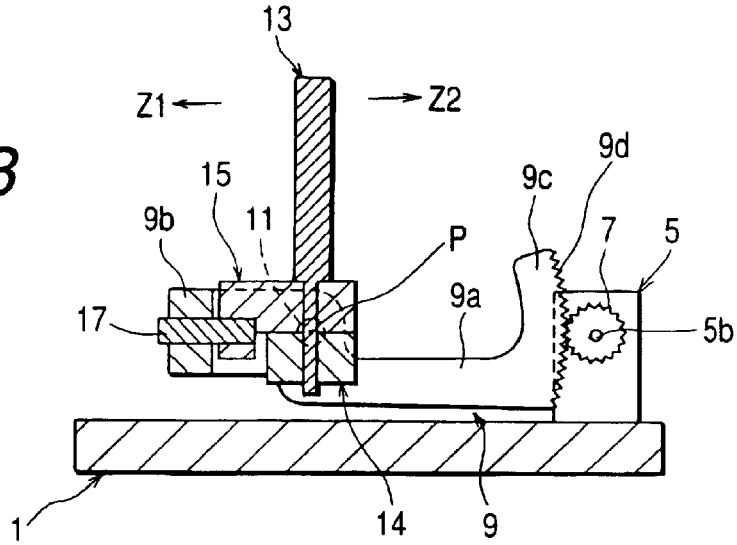
FIG. 3 is a sectional view of a main part of the first embodiment of the input apparatus of the invention.

Drawings of an input apparatus of the invention will be explained. FIG. 1 is a plan view of a first embodiment of the input apparatus of the invention, FIG. 2 is a sectional view along line 2—2 of FIG. 1, FIG. 3 is a sectional view of a main part of the first embodiment of the input apparatus of the invention, FIG. 4 relate to the first embodiment of the input apparatus of the invention and is an operation explanatory view showing a state in which an operating member is tilted left, FIG. 5 relates to the first embodiment of the input apparatus of the invention and is an operation explanatory view showing a state in which the operating member is tilted right, FIG. 6 relates to the first embodiment of the input apparatus of the invention and is an exploded perspective view showing the operating member, a driving body, and a driving lever, and FIG. 7 relates to the first embodiment of the input apparatus of the invention and is a perspective view of a support member.

Figure 8:
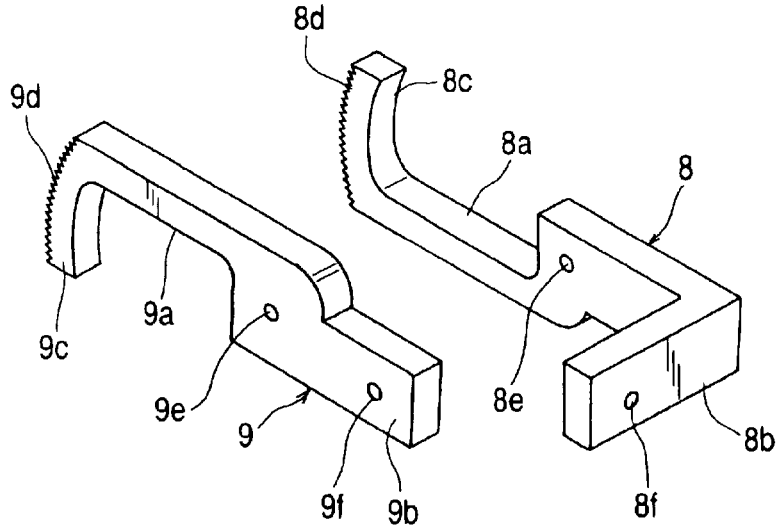
FIG. 8 is a perspective view of a second embodiment of an input apparatus of the invention and showing a driving lever.
Figure 9:
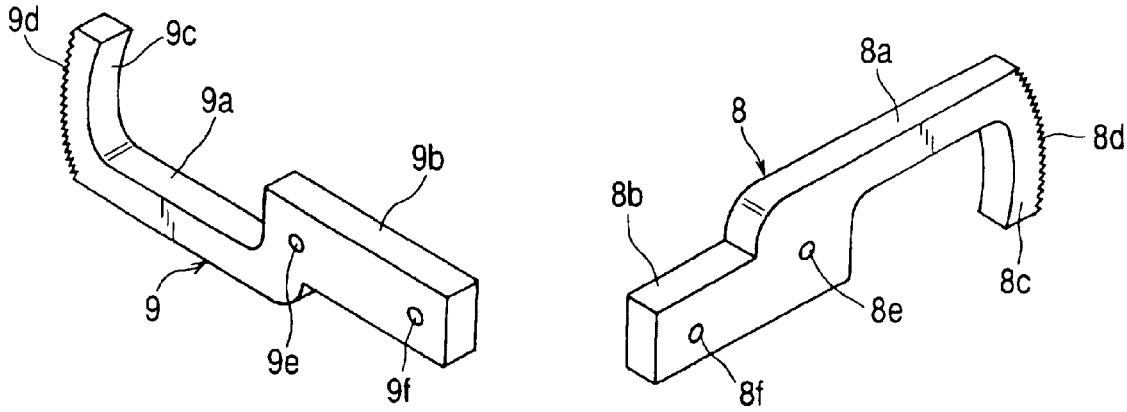
FIG. 9 is a perspective view of a third embodiment of an input apparatus of the invention and showing a driving lever.
Figure 10:
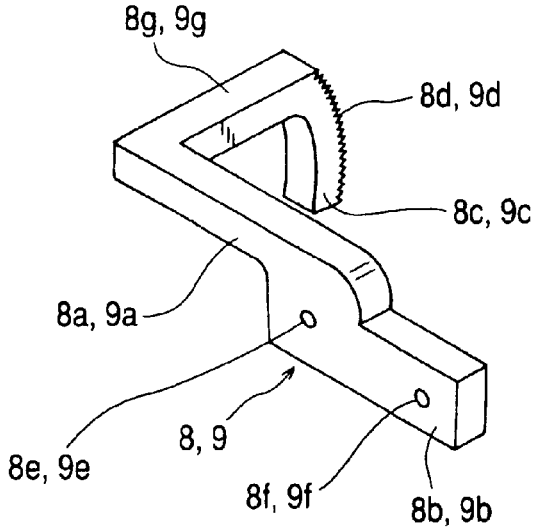
FIG. 10 is a perspective view of a fourth embodiment of an input apparatus of the invention and showing a driving lever.
Figure 11:
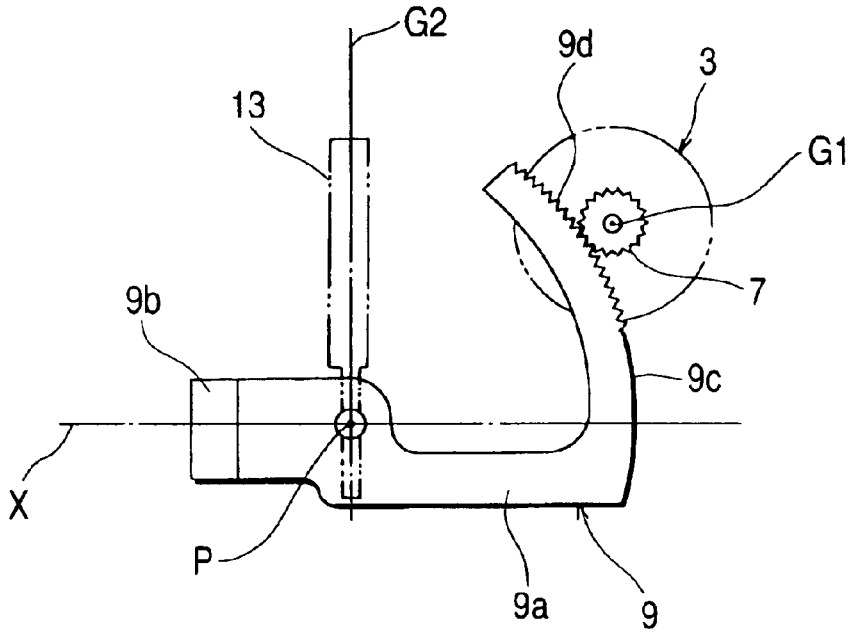
FIG. 11 is a perspective view of a fifth embodiment of an input apparatus of the invention and showing an attachment state of a motor.
Figure 12:
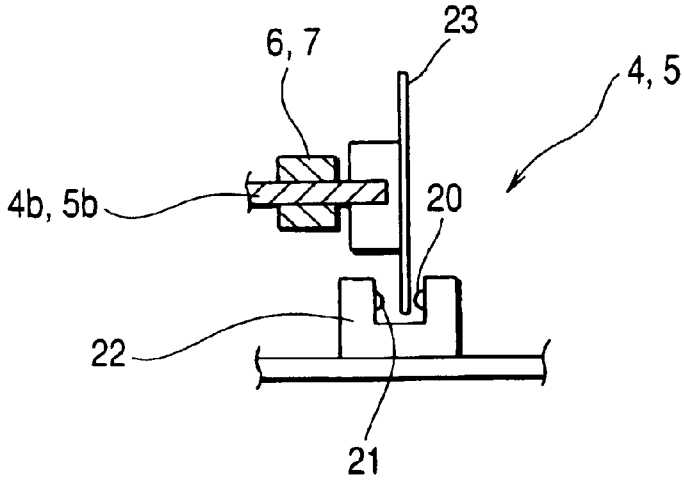
FIG. 12 is a main part sectional side view of a sixth embodiment of an input apparatus of the invention and showing a structure of a rotary type electrical component.
Figure 13:
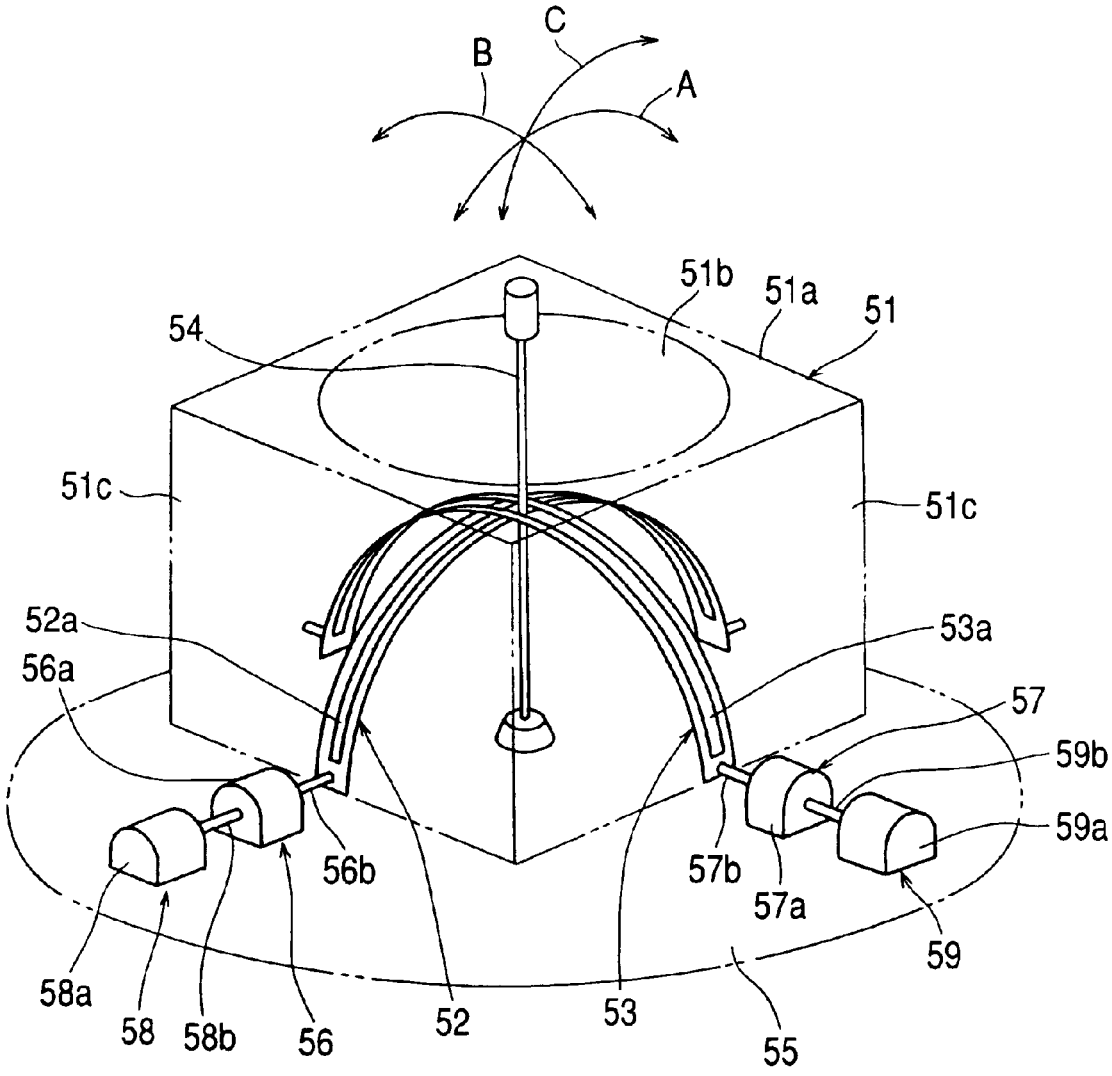
FIG. 13 PRIOR ART
FIG. 13 is a perspective view of a conventional input apparatus.

Besides, FIG. 8 relates to a second embodiment of an input apparatus of the invention and is a perspective view showing a driving lever, FIG. 9 relates to a third embodiment of an input apparatus of the invention and is a perspective view showing a driving lever, FIG. 10 relates to a fourth embodiment of an input apparatus of the invention and is a perspective view showing a driving lever, FIG. 11 relates to a fifth embodiment of an input apparatus of the invention and is an explanatory view showing an attachment state of a motor, and FIG. 12 relates to a sixth embodiment of an input apparatus of the invention and is a main part sectional side view showing a structure of a rotary type electrical component.

Next, the structure of the first embodiment of the input apparatus of the invention will be described on the basis of FIGS. 1 to 7. A support member 1 made of a molded article of synthetic resin includes, especially as shown in FIG. 7, a first and a second regions 1*a* and 1*b* provided at positions diagonally opposite to each other, a coupling portion 1*c* for coupling the first and the second regions 1*a* and 1*b*, pairs of attachment portions 1*d* and 1*e* protruding upward from the first and the second regions 1*a* and 1*b* and provided at a distance from each other, a pair of support portions 1*f* and 1*g* protruding upward from the first and the second regions 1*a* and 1*b* and provided to be a little near the coupling portion 1*c*, clearance holes 1*h* and 1*j* each provided in the vicinity of one of the attachment portions 1*d* and 1*e* and provided in the first and the second regions 1*a* and 1*b*, and a hole 1*k* provided in the coupling portion 1*c*.

A first and a second motors 2 and 3 respectively include main body portions 2*a* and 3*a*, and rotating shafts 2*b* and 3*b* rotatably attached to the main body portions 2*a* and 3*a*.

The first motor 2 is attached to the first region 1*a* while front and rear sides of the main body portion 2*a* are retained to the pair of attachment portions 1*d*, and the second motor 3 is attached to the second region 1*b* while front and rear sides of the main body portion 3*a* are retained to the pair of attachment portions 1*e*.

Then, when the first and the second motors 2 and 3 are attached, as shown in FIG. 1, axial lines G1 of the rotating shafts 2*b* and 3*b* are disposed in a state where they are orthogonal to each other.

A first and a second rotary type electrical components 4 and 5 made of rotary type sensors, such as encoders, or rotary type variable resistors respectively include main body portions 4*a* and 5*a*, and rotating shafts 4*b* and 5*b* rotatably attached to the main body portions 4*a* and 5*a*.

The first rotary type electrical component 4 is attached to the support member 1, and the rotating shaft 4*b* is coaxially integrally formed with the rotating shaft 2*b* of the first motor 2, and further, the second rotary type electrical component 5 is attached to the support member 1, and the rotating shaft 5*b* is coaxially integrally formed with the rotating shaft 3*b* of the second motor 3.

By such structure, the rotating forces of the rotating shafts 4*b* and 5*b* of the first and the second rotary type electrical components 4 and 5 are transmitted to the rotating shafts 2*b* and 3*b* of the first and the second motors 2 and 3, and the rotating forces of the rotating shafts 2*b* and 3*b* of the first and the second motors 2 and 3 can be transmitted to the rotating shafts 4*b* and 5*b* of the first and the second rotary type electrical components 4 and 5.

Further, when the rotating shafts 4*b* and 5*b* are rotated, the first and the second rotary type electrical components 4 and 5 are operated.

Incidentally, in this embodiment, although the description has been given of the case where the rotating shafts of the motors are coaxially and integrally formed with the rotating shafts of the rotary type electrical components, the rotating shafts of the motor and the rotary type electrical component may be constituted by separate parts, and both the rotating shafts of the separate parts are coupled with each other by a coupling member, or gears are attached to the rotating shafts constituted by the separate parts and the gears are engaged with each other, so that the rotating force of the rotating shaft of the rotary type electrical component is transmitted to the rotating shaft of the motor, or the rotating force of the rotating shaft of the motor is transmitted to the rotating shaft of the rotary type electrical component.

Besides, the first and the second motors 2 and 3 and the first and the second rotary type electrical components 4 and 5 are in the state where they are attached to the support member 1 on the same plane.

Then, a first and a second gears 6 and 7 are attached to the rotating shafts 4*b* and 5*b* of the first and the second rotary type electrical components 4 and 5, and the first and the second rotary type electrical components 4 and 5 are operated by the rotation of the first and the second gears 6 and 7.

Figure 6:
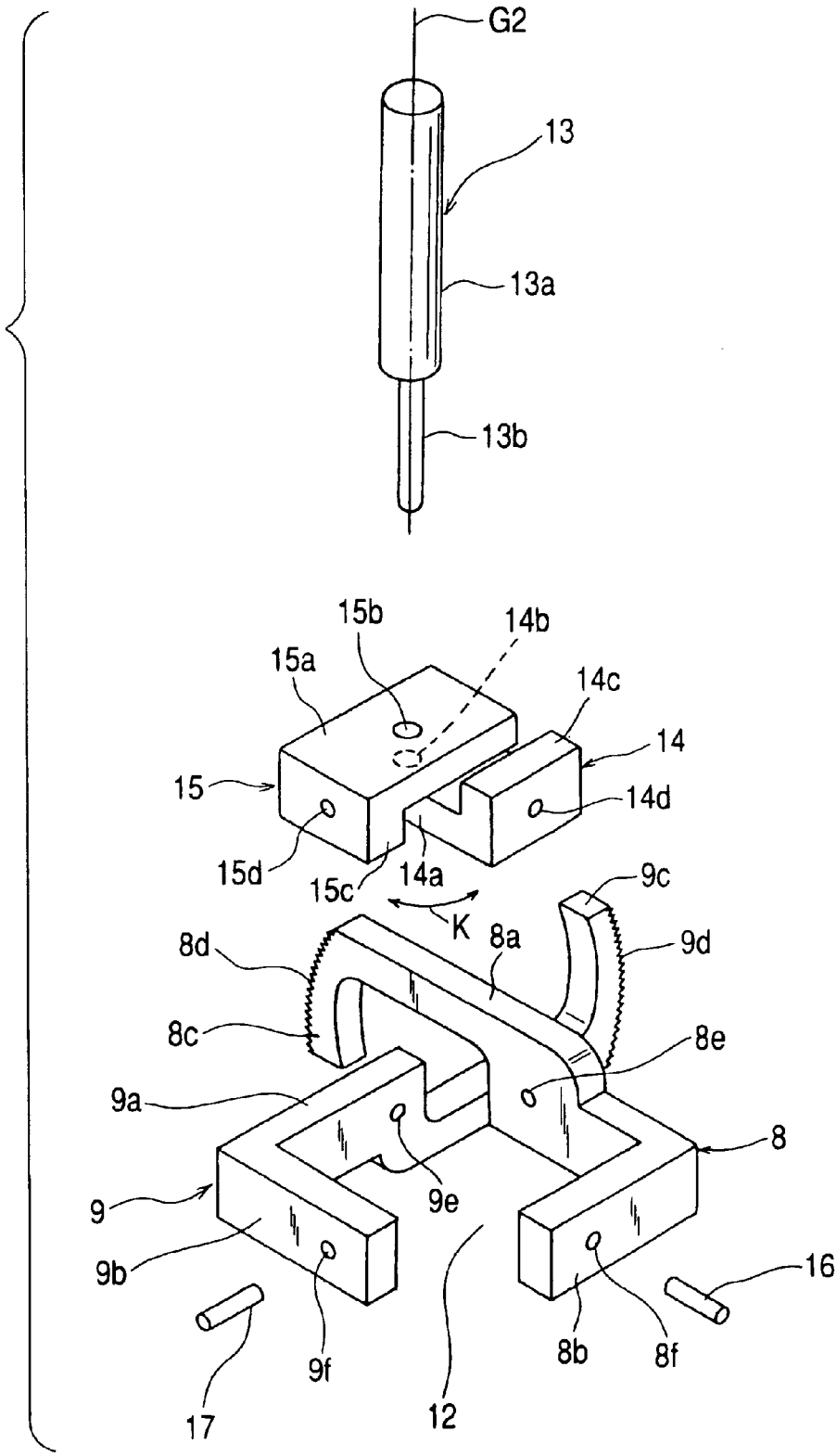
FIG. 6 is an exploded perspective view of the first embodiment of the input apparatus of the invention and showing an operating member, a driving body, and a driving lever.
Figure 7:
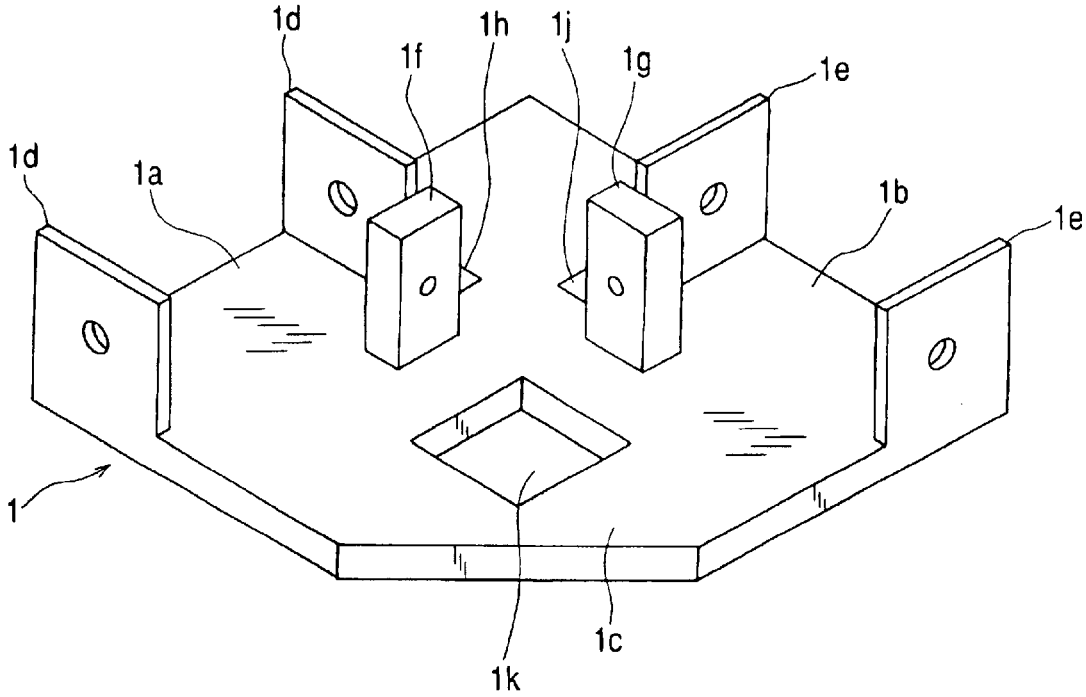
FIG. 7 is a perspective view of the first embodiment of the input apparatus of the invention and showing a support member.

A first and a second driving levers 8 and 9 made of molded articles of synthetic resin include, especially as shown in FIG. 6, linearly extending arm portions 8*a* and 9*a*, attachment portions 8*b* and 9*b* formed to be bent perpendicularly from one end sides of the arm portions 8*a* and 9*a*, protrusions 8*c* and 9*c* protruding to form arc shapes from the other end sides of the arm portions 8*a* and 9*a*, tooth portions 8*d* and 9*d* provided on arc-shaped outer peripheral surfaces of the arc-shaped protrusions 8*c* and 9*c*, holes 8*e* and 9*e* provided in the arm portions 8*a* and 9*a* positioned between the attachment portions 8*b* and 9*b* and the tooth portions 8*d* and 9*d* and holes 8*f* and 9*f* provided in the attachment portions 8*b* and 9*b*.

Then, the first driving lever 8 is disposed in the state where the arm portion 8*a* is perpendicular to the axial line G1 of the first motor 2, and is supported by a shaft portion 10 inserted in the hole 8*e* and attached to the support portion 1*g* so that a seesaw operation can be performed.

When this first driving lever 8 is attached, the tooth portion 8*d* is engaged with the first gear 6, and the first driving lever 8 becomes possible to perform a seesaw operation with the shaft portion 10 as the center, and when the first driving lever 8 performs the seesaw operation, the attachment portion 8*b* is moved up and down, and the tooth portion 8*d* of the one end side of the arm portion 8*a* performs a movement opposite to the attachment portion 8*b* and is moved up and down.

Then, the first gear 6 is rotated by the up and down movement of the tooth portion 8*d*, and as a result, the rotating shaft 4*b* is rotated, and the operation of the first rotary type electrical component 4 is performed.

Besides, the second lever 9 is disposed in a state where the arm portion 9*a* is perpendicular to the axial line G1 of the second motor 3, and is supported by a shaft portion 11 inserted in the hole 9*e* and attached to a support portion 1*f* so that a seesaw operation can be performed.

When this second driving lever 9 is attached, the tooth 9*d* is engaged with the second gear 7, and the second driving lever 9 becomes possible to perform the seesaw operation with the shaft portion 11 as the center, and when the second driving lever 9 performs the seesaw operation, the attachment portion 9*b* is moved up and down, and the tooth portion 9*d* of the one end side of the arm portion 9*a* performs a movement opposite to the attachment portion 9*b* and is moved up and down.

Then, the second gear 7 is rotated by the up and down movement of this tooth portion 9*d*, and as a result, the rotating shaft 5*b* is rotated, and the operation of the second rotary type electrical component 5 is performed.

When the first and the second driving levers 8 and 9 are attached, the respective arm portions 8*a* and 9*a* are disposed in a state where they intersect each other at right angles and cross each other, and the state is such that a space portion 12 is formed at a place surrounded by the arm portions 8*a* and 9*a* and the bent attachment portions 8*b* and 9*b*.

Further, the first and the second driving levers 8 and 9 have the same size, shape and structure, and as shown in FIG. 6, both are arranged to be opposite to each other in the vertical direction.

That is, the protrusion 8*c* of the first driving lever 8 is protruded downward, and the protrusion 9*c* of the second driving lever 9 is protruded upward, so that their collision can be avoided in the seesaw operation.

An operating member 13 made of synthetic resin or metal includes an operation portion 13*a* made of a large diameter and a holding portion 13*b* provided to extend from this operation portion 13*a* in the direction of an axial line G2 and having a small diameter.

A first and a second driving bodies 14 and 15 made of synthetic resin or metal respectively form L shapes, especially as shown in FIG. 6, and includes plate-like portions 14*a* and 15*a* perpendicular to the direction of the axial line G2, holes 14*b* and 15*b* provided in the plate-like portions 14*a* and 15*a* to pass through them vertically, side plate portions 14*c* and 15*c* having flat surfaces extending from ends of the plate-like portions 14*a* and 15*a* in the direction of the axial line G2, and holes 14*d* and 15*d* provided in the side plate portions 14*c* and 15*c*.

Then, the directions of the side plate portions 14*c* and 15*c* of the first and the second driving bodies 14 and 15 are opposite to each other with respect to the direction of the axial line G2, and they are protruded toward the plate-like portions 14*a* and 15*a*, and in the state where the plate-like portions 14*a* and 15*a* are superposed on each other, the holding portion 13*b* of the operating member 13 is inserted in each of the holes 14*b* and 15*b*, and the first and the second driving bodies 14 and 15 are attached to the holding portion 13*b* by suitable means so that the operating member 13 does not come away from the first and the second driving bodies 14 and 15.

Besides, when the first and the second driving bodies 14 and 15 are attached, each of the side plate portions 14*c* and 15*c* is in an orthogonal state, and each of the first and the second driving bodies 14 and 15 can be rotated in the direction of an arrow K (clockwise direction and counterclockwise direction) with the holding portion 13*b* as an axis.

Then, the first and the second driving bodies 14 and 15 coupled with the operating member 13 are inserted in the space portion 12 formed by the first and the second driving levers 8 and 9, a shaft portion 16 is inserted in a hole 8*f* provided in the attachment portion 8*b* of the first driving lever 8 and the hole 14*d* of the side plate portion 14*c*, the operating member 13 and the first driving body 14 are attached by this shaft portion 16, and a rotation can be made between both by the shaft portion 16.

Besides, a shaft portion 17 is inserted in a hole 9*f* provided in the attachment portion 9*b* of the second driving lever 9 and the hole 15*d* of the side plate portion 15*c*, the operating member 13 and the second driving body 15 are attached by this shaft portion 17, and a rotation can be made between both by the shaft portion 17.

When the operating member 13 and the first and the second driving bodies 14 and 15 are attached to the first and the second driving levers 8 and 9, the operating member 13 can perform a tilting operation with a tilt center P as the center, and the first and the second driving bodies 14 and 15 are positioned apart from the upper surface of the support member 1, and in a neutral state of the operating member 13 at the time of non-operation, the direction of the axial line G2 of the operating member 13 is perpendicular to the support member 1.

Besides, when the operating member 13 is attached, the arm portions 8*a* and 9*a* of the first and the second driving levers 8 and 9 are put in the state where they are disposed to be perpendicular to each other on a vertical surface orthogonal to the direction of the axial line G2, and attachment positions of the first and the second motors 2 and 3 and the first and the second rotary type electrical components 4 and 5 are on the same plane in a state where a horizontal X direction passing the tilt center P of the first and the second driving bodies 14 and 15 and perpendicular to the direction of the axial line G2 of the operating member 13 is coincident with the axial lines G1 of the first and the second motors 2 and 3.

Figure 4:
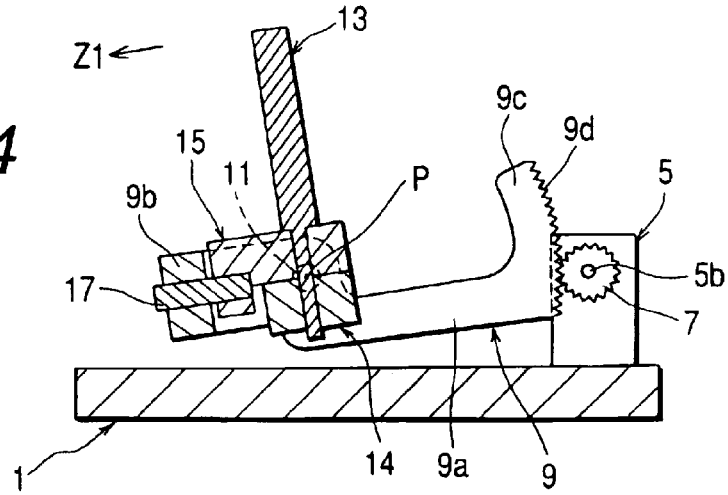
FIG. 4 is an operation explanatory view of the first embodiment of the input apparatus of the invention and showing a state where an operating member is tilted left.

Next, the operation of the input apparatus of the invention having the structure as described above will be described. First, from the neutral state as shown in FIG. 3, when the operating member 13 is tilted in the direction of an arrow Z1 (direction in which the arm portion 9*a* of the second driving lever 9 extends), as shown in FIG. 4, the first and the second driving bodies 14 and 15 are also tilted in accordance with the operating member 13, with the tilt center P as the center.

At this time, the shaft portion 17 catches the attachment portion 9*b* of the second driving lever 9, and the second driving body 15 moves the attachment portion 9*b* downward in the direction of the axial line G2.

Then, the second driving lever 9 performs the seesaw operation with the shaft portion 11 as the fulcrum, and as a result, the tooth portion 9*d* positioned at the end side of the arm portion 9*a* of the second driving lever 9 is moved upward in the direction of the axial line G2, the gear 7 is rotated by this, and the operation of the second rotary type electrical component 5 is performed.

Besides, the other first driving body 14 performs a rotating operation with the shaft portion 16 as the center, and the first driving lever 8 does not perform the seesaw operation, and accordingly, it is in the neutral state without causing the up and down movement.

Figure 5:
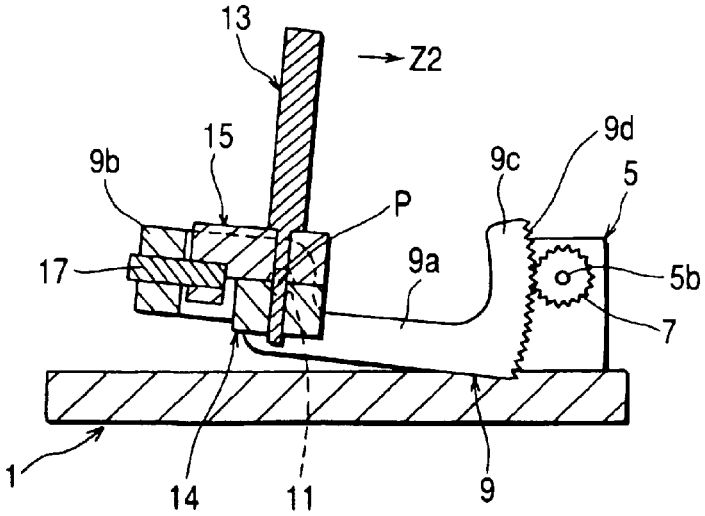
FIG. 5 is an operation explanatory view of the first embodiment of the input apparatus of the invention and showing a state where an operating member is tilted right.

Next, when the operating member 13 is tilted in the direction of an arrow Z2 (direction in which the arm portion 9*a* of the second driving lever 9 extends) from the neutral state, as shown in FIG. 5, in accordance with the operating member 13, the first and the second driving bodies 14 and 15 are also tilted with the tilt center P as the center.

At this time, the shaft portion 17 catches the attachment portion 9*b* of the second driving lever 9, and the second driving body 15 moves the attachment portion 9*b* upward in the direction of the axial line G2.

Then, the second driving lever 9 performs the seesaw operation with the shaft portion 11 as the fulcrum, and as a result, the tooth portion 9*d* positioned at the end side of the arm portion 9*a* of the second driving lever 9 is moved downward in the direction of the axial line G2, the gear 7 is rotated by this, and the operation of the second rotary type electrical component 5 is performed.

Besides, the other first driving body 14 performs a rotating operation with the shaft portion 16 as the center, and the first driving lever 8 does not perform the seesaw operation, and accordingly, it is in the neutral state without causing the up and down movement.

Next, when the operating member 13 is tilted in the direction of an arrow Z3 (direction in which the arm portion 8*a* of the first driving lever 8 extends) from the neutral state, in accordance with the operating member 13, the first and the second driving bodies 14 and 15 are also tilted with the tilt center P as the center.

At this time, the shaft portion 16 catches the attachment portion 8*b* of the first driving lever 8, and the first driving body 14 moves the attachment portion 8*b* downward in the direction of the axial line G2.

Then, the first driving lever 8 performs the seesaw operation with the shaft portion 10 as the fulcrum, and as a result, the tooth portion 8*d* positioned at the end side of the arm portion 8*a* of the first driving lever 8 is moved upward in the direction of the axial line G2, the gear 6 is rotated by this, and the operation of the first rotary type electrical component 4 is performed.

Besides, the other second driving body 15 performs the rotating operation with the shaft portion 17 as the center, and the second driving lever 9 does not perform the seesaw operation, and accordingly, it is in the neutral state without causing the up and down movement.

Next, when the operating member 13 is tilted in the direction of an arrow Z4 (direction in which the arm portion 8*a* of the first driving lever 8 extends) from the neutral portion, in accordance with the operating member 13, the first and the second driving bodies 14 and 15 are also tilted with the tilt center P as the center.

At this time, the shaft portion 16 catches the attachment portion 8*b* of the first driving lever 8, and the first driving body 14 moves the attachment portion 8*b* upward in the direction of the axial direction G2.

Then, the first lever 8 performs the seesaw operation with the shaft portion 10 as the fulcrum, and as a result, the tooth portion 8*d* positioned at the end side of the arm portion 8*a* of the first driving lever 8 is moved downward in the direction of the axial line G2, the gear 6 is rotated by this, and the operation of the first rotary type electrical component 4 is performed.

Besides, the other second driving body 15 performs a rotating operation with the shaft portion 17 as the center, and the second driving lever 9 does not perform the seesaw operation, and accordingly, it is in the neutral state without causing the up and down movement.

Next, when the operating member 13 is tilted in the direction of an arrow Z5 between the direction of the arrow Z1 and the direction of the arrow Z3 from the neutral state, in accordance with the operating member 13, the first and the second driving bodies 14 and 15 are also tilted with the tilt center P as the center.

At this time, the shaft portion 16 of the first driving body 14 catches the attachment portion 8b of the first driving lever 8, and the shaft portion 17 of the second driving body 15 catches the attachment portion 9*b* of the second driving lever 9, and they move both the attachment portions 8*b* and 9*b* downward in the direction of the axial line G2.

Then, the first and the second driving levers 8 and 9 respectively perform the seesaw operations with the shaft portions 10 and 11 as the fulcrums, and as a result, the tooth portions 8*d* and 9*d* positioned at the end sides of the arm portions 8*a* and 9*a* of the first and the second driving levers 8 and 9 are moved upward in the direction of the axial line G2, the gears 6 and 7 are rotated by this, and the operations of the first and the second rotary type electrical components 4 and 5 are performed.

Besides, at the time of the tilt of the first and the second driving bodies 14 and 15 in the direction of the arrow Z5, since the distances in the neutral state between the shaft portion 10 and the shaft portion 16, and between the shaft portion 11 and the shaft portion 17 vary from the distances at the time of the tilt, the first and the second driving bodies 14 and 15 perform the rotating operation with the operating member 13 as the center, and a smooth tilt operation is performed.

Next, when the operating member 13 is tilted in the direction of an arrow Z6 between the direction of the arrow Z2 and the direction of the arrow Z4 from the neutral state, in accordance with the operating member 13, the first and the second driving bodies 14 and 15 are tilted with the tilt center P as the center.

At this time, the shaft portion 16 of the first driving body 14 catches the attachment portion 8*b* of the first driving lever 8, the shaft portion 17 of the second driving body 15 catches the attachment portion 9*b* of the second driving lever 9, and they move the attachment portions 8*b* and 9*b* upward in the direction of the axial line G2.

Then, the first and the second driving levers 8 and 9 respectively perform the seesaw operations with the shaft portions 10 and 11 as the fulcrums, and as a result, the tooth portions 8*d* and 9*d* positioned at the end sides of the arm portions 8*a* and 9*a* of the first and the second driving levers 8 and 9 are moved downward, the gears 6 and 7 are rotated by this, and the operations of the first and the second rotary type electrical components 4 and 5 are performed.

Besides, also at the time of the tilt of the first and the second driving bodies 14 and 15 in the direction of the arrow Z6, similarly to the direction of the arrow Z5, the first and the second driving bodies 14 and 15 perform the rotation operation with the operating member 13 as the center, and the smooth tilt operation is performed.

Next, when the operating member 13 is tilted in the direction of an arrow Z7 between the direction of the arrow Z1 and the direction of the arrow Z4 from the neutral state, in accordance with the operating member 13, the first and the second driving bodies 14 and 15 are also tilted with the tilt center P as the center.

At this time, the shaft portion 16 of the first driving body 14 catches the attachment portion 8*b* of the first driving lever 8 to move the attachment portion 8*b* upward in the direction of the axial line G2, whereas the shaft portion 17 of the other second driving body 15 catches the attachment portion 9*b* of the second driving lever 9 to move the attachment portion 9*b* downward in the direction of the axial line G2.

Then, the first and the second driving levers 8 and 9 respectively perform the seesaw operations with the shaft portions 10 and 11 as the fulcrums, and as a result, the tooth portion 8*d* positioned at the end side of the arm portion 8*a* of the first driving lever 8 is moved downward in the direction of the axial line G2, the tooth portion 9*d* positioned at the end side of the arm portion 9*a* of the second driving lever 9 is moved upward in the direction of the axial line G2, the gears 6 and 7 are rotated by this, and the operations of the first and the second rotary type electrical components 4 and 5 are performed.

Besides, also at the time of the tilt of the first and the second driving bodies 14 and 15 in the direction of the arrow Z7, the first and the second driving bodies 14 and 15 perform the rotation operation with the operating member 13 as the center, and the smooth tilt operation is performed.

Next, when the operating member 13 is tilted in the direction of an arrow Z8 between the direction of the arrow Z2 and the direction of the arrow Z3 from the neutral state, in accordance with the operating member 13, the first and the second driving bodies 14 and 15 are also tilted with the tilt center P as the center.

At this time, the shaft portion 16 of the first driving body 14 catches the attachment portion 8*b* of the first driving lever 8 to move the attachment portion 8*b* downward in the direction of the axial line G2, whereas the shaft portion 17 of the driving body 15 of the other second driving body 15 catches the attachment portion 9*b* of the second driving lever 9 to move the attachment portion 9*b* upward in the direction of the axial line G2.

Then, the first and the second driving levers 8 and 9 respectively perform the seesaw operations with the shaft portions 10 and 11 as the fulcrums, and as a result, the tooth portion 8*d* positioned at the end side of the arm portion 8*a* of the first driving lever 8 is moved upward in the direction of the axial line G2, the tooth portion 9*d* positioned at the end side of the arm portion 9*a* of the second driving lever 9 is moved downward in the direction of the axial line G2, the gears 6 and 7 are rotated by this, and the operations of the first and the second rotary type electrical components 4 and 5 are performed.

Also at the time of the tilt of the first and the second driving bodies 14 and 15 in the direction of the arrow Z8, the first and the second driving bodies 14 and 15 perform the rotating operation with the operating member 13 as the center, and the smooth tilt operation is performed.

Then, by such operation, the first and the second rotary type electrical components 4 and 5 are operated, and the tilt position of the operating member 13 is detected.

Further, at the time of the tilt operation of the operating member 13, signals are sent from a control portion (not shown) to the first and the second motors 2 and 3, the first and the second motors 2 and 3 are driven, and the driving forces are transmitted to the rotating shafts 4*b* and 5*b* of the first and the second rotary type electrical components 4 and 5.

Then, the driving forces of the first and the second motors 2 and 3 function as drag (inner force sense or haptic) against the tilt operation of the operating member 13.

FIG. 8 shows a second embodiment of an input apparatus of the invention, and in this second embodiment, although a first driving lever 8 has a similar structure as the first embodiment, a second driving lever 9 has a structure that an arm portion 9*a* and an attachment portion 9*b* are arranged linearly, and the first and the second driving levers 8 and 9 are disposed in parallel with each other.

Since the other structure is the same as the first embodiment, the same parts are designated by the same numerals and the description is omitted here.

By such structure, a first and a second motors 2 and 3 and a first and a second rotary type electrical components 4 and 5 can be disposed at positions different from the first embodiment, and the arrangement can be made to have the degree of freedom.

FIG. 9 shows a third embodiment of an input apparatus of the invention, and in this third embodiment, a first and a second driving levers 8 and 9 respectively have structures that arm portions 8*a* and 9*a* and attachment portions 8*b* and 9*b* are linearly arranged, and a first and a second driving levers 8 and 9 do not cross each other but are disposed in an orthogonal state.

Since the other structure is similar to the first embodiment, the same parts are designates by the same numerals and the description is omitted here.

By such structure, a first and a second motors 2 and 3 and a first and a second rotary type electrical components 4 and 5 can be disposed at positions different from the first embodiment, and the arrangement can be made to have the degree of freedom.

FIG. 10 shows a fourth embodiment of an input apparatus of the invention, and in the fourth embodiment, a first and a second driving levers 8 or 9 respectively have structures that arm portions 8*a* and 9*a* and attachment portions 8*b* and 9*b* are disposed linearly, bent portions 8g and 9g bent at right angles from the ends of the arm portions 8 and 9 are provided, and protrusions 8c and 9c and tooth portions 8d and 9d are provided at end portions of the bent portions 8g and 9g.

By such structure, a first and a second motors 2 and 3 and a first and a second rotary type electrical components 4 and 5 can be disposed at positions different from the first embodiment, and the arrangement can be made to have the degree of freedom.

FIG. 11 shows a fifth embodiment of an input apparatus of the invention, and in this fifth embodiment, a second motor 3 is disposed in a state in which an axial line G1 of the second motor 3 is positioned above a position of a horizontal X direction passing a tilt center P of a first and a second driving levers 8 and 9 and perpendicular to a direction of an axial line G2, a protrusion 9c of the second driving lever 9 is made long, and a tooth portion 9d is engaged with a gear 7 provided at the second motor 3.

Since the other structure is the same as the first embodiment, the same parts are designated by the same numerals and the description is omitted here.

By such structure, as compared with a case where the second motor 3 is attached in a state in which the axial line G1 of second motor 3 is at a position on the horizontal X direction perpendicular to the direction of the axial line G2, the second motor 3 can be attached at a position closer to the side of an operating member 13, and a space in the horizontal direction can be made small.

Besides, in the fifth embodiment, although the description has been given of the case where the axial line G1 of the second motor 3 is positioned above the horizontal X direction, an axial line G1 of a first motor 2 may be positioned above the horizontal X direction and the first motor 2 may be attached.

Besides, the axial line G1 of the second motor 3 may be positioned above the horizontal X direction, whereas the axial line G1 of the first motor 2 may be positioned below the horizontal X direction, and the first and the second motors 2 and 3 may be attached.

Further, the axial lines G1 of both the first and the second motors 2 and 3 may be positioned above or below the horizontal X direction, and the first and the second motors 2 and 3 may be attached.

FIG. 12 shows a sixth embodiment of an input apparatus of the invention, and in this sixth embodiment, a first and a second rotary type electrical components 4 and 5 are constituted by photo interrupters (translucent encoder), a light emitting element 20 and a light receiving element 21 are attached to a holding body 22, a rotation body 23 made of a code plate provided with a slit (not shown) is attached to rotating shafts 4b and 5b, and in accordance with the rotation of the rotating shafts 4b and 5b by the rotation of gears 6 and 7 attached to the rotating shafts 4b and 5b, the rotation body 23 performs a rotating operation between the light emitting element 20 and the light receiving element 21, and rotation detection is performed by this.

Incidentally, in the above embodiments, the description has been given of the case where the motor for the inner force sense is used, however, the invention may be applied to an input apparatus in which this motor is not used and the inner force sense is not provided.

Besides, in the above embodiments, although the description has been given of the case where the gear mechanism is used for rotation transmission, rotation transmission by frictional means or the like may be used.

Besides, in the above embodiments, although the description has been given of the case where the first and the second driving bodies are used, one driving body may be used, and backlash for allowing the driving body to rotate may be provided at a side of an attachment portion of a driving lever or between a side of the driving body and a shaft portion, and the driving body may perform a tilt operation.

The input apparatus of the invention is made to have the structure that at the time of the tilt operation of the operating member 13, the driving bodies 14 and 15, together with the operating member 13, perform the tilt operation to move the attachment portions 8b and 9b of the first and the second driving levers 8 and 9 up and down in the direction of the axial line G2, the arm portions 8a and 9a of the first and the second driving levers 8 and 9 respectively perform the seesaw operations with the shaft support portions as the centers, the end sides of the arm portions 8a and 9a positioned opposite to the attachment portions 8b and 9b with the shaft support portions between them are respectively moved up and down in the direction of the axial line G2, and the first and the second rotary type electrical components 4 and 5 are respectively operated by the movements of the end sides of the arm portions 8a and 9a.

By this structure, since the driving levers 8 and 9 perform the seesaw operations, it is not necessary to perform a rotating operation by an arc shape like a conventional interlocking member, a space in the vertical direction can be made small, and an input apparatus which can be miniaturized in the vertical direction can be provided.

What is claimed is:

1. An input apparatus, comprising:

a tiltable operating member;

a driving body provided to the operating member in an axial line direction;

at least one pair of first and second driving levers which can perform a seesaw operation in response to a tilt operation of the operating member and include attachment portions and arm portions coupled with each other; and first and second rotary electrical components operated by the first and the second driving levers, respectively, wherein the attachment portions are orthogonal to each other, and are coupled with lateral face sides of the driving body, the arm portions crossover each other, when the operating member tilts, the attachment portions move up and down in the axial line direction and each of the arm portions performs a seesaw operation with a shaft support portion as a center, each of end sides of the arm portions positioned at a side opposite to the attachment portion with the shaft support portion between the end sides is moved up and down, the first and the second rotary electrical components are respectively operated by movement of the end sides of the arm portions, the driving body includes first and second driving bodies rotatably attached to the operating member, the attachment portions are held by first shaft portions to the first and second driving bodies, each of the first and the second driving bodies is formed in an L shape having a first portion through which a hole passes and a second portion, the first portions overlap, and the operating member is inserted through the holes to couple the operating member and the first and second driving bodies.

2. An input apparatus as set forth in claim 1, wherein the first portions are plate-like and disposed perpendicular to the axial line direction, each of the second portions has a flat surface extending in the axial line direction, and the second portions are directed towards each other.

3. An input apparatus as set forth in claim 1, wherein tooth portions engaging with gears provided in the first and the second rotary electrical components are provided at the end sides of the first and the second driving levers, the arm portions of the first and the second driving levers are supported between the first shaft portion and the tooth portion by a second shaft portion to a support member to which the first and the second driving levers are attached, the first and the second driving levers can perform a seesaw operation with the second shaft portion as a center, and at a time of the tilt operation of the operating member, the first and the second driving levers perform the seesaw operation correspondingly to the tilt operation of the first and the second driving bodies, the gear is rotated by the tooth portion, and the first and the second rotary electrical components are operated.

4. An input apparatus as set forth in claim 1, wherein the attachment portions of the first and the second driving levers are respectively formed by bending the arm portion perpendicularly.

5. An input apparatus as set forth in claim 1, wherein a motor for transmitting an inner force sense to the operating member is disposed correspondingly to each of the first and the second driving levers.

6. An input apparatus as set forth in claim 5, wherein a rotating shaft of the rotary electrical component and a rotating shaft of the motor are coaxially integrally formed, and a gear is attached to the rotating shaft.

7. An input apparatus as set forth in claim 5, wherein the motors respectively provided correspondingly to the first and the second driving levers are disposed on a same plane.

8. An input apparatus as set forth in claim 5, wherein at least one of the motors is disposed in a state where an axial line of the motor is positioned above or below a position passing a tilt center of the driving body and in a direction perpendicular to the axial line direction.

9. An input apparatus as set forth in claim 5, wherein the motor is disposed in a state where an axial line of the motor is perpendicular to a direction in which the arm extends.

10. An input apparatus as set forth in claim 1, wherein the arm portions crossover each other at right angles.

11. An input apparatus as set forth in claim 1, wherein:

the attachment portions are disposed along a plane orthogonal to the axial line direction and are coupled with the lateral face sides of the driving body in the axial line direction, and the arm portions are disposed in a direction perpendicular to the axial line direction.

12. An input apparatus comprising:

a tiltable operating member;

a driving body provided to the operating member in an axial line direction;

at least one pair of first and second driving levers which can perform a seesaw operation in response to a tilt operation of the operating member and include attachment portions and arm portions coupled with each other; and first and second rotary electrical components operated by the first and the second driving levers, respectively, wherein the attachment portions of the first and second driving levers are coupled with lateral face sides of the driving body in the axial line direction, the arm portions are one of orthogonal to each other and are parallel with each other, when the operating member is tilted, the attachment portions move up and down in the axial line direction and each of the arm portions performs a seesaw operation with a shaft support portion as a center, each of end sides of the arm portions positioned at a side opposite to the attachment portion with the shaft support portion between the end side is moved up and down, the first and second rotary electrical components are operated by movement of the end sides of the arm portions, and the arm portions crossover each other at right angles.

13. An input apparatus as set forth in claim 12, wherein tooth portions engaging with gears provided in the first and the second rotary electrical components are provided at the end sides of the first and the second driving levers, the arm portions of the first and the second driving levers are supported between a first shaft portion and the tooth portion by a second shaft portion to a support member to which the first and the second driving levers are attached, the first and the second driving levers can perform a seesaw operation with the second shaft portion as a center, and at a time of the tilt operation of the operating member, the first and the second driving levers perform the seesaw operation correspondingly to the tilt operation of first and the second driving bodies, the gear is rotated by the tooth portion, and the first and the second rotary electrical components are operated.

14. An input apparatus as set forth in claim 12, wherein the attachment portions of the first and the second driving levers are respectively formed by bending the arm portion perpendicularly.

15. An input apparatus as set forth in claim 14, wherein a motor for transmitting an inner force sense to the operating member is disposed correspondingly to each of the first and the second driving levers.

16. An input apparatus as set forth in claim 15, wherein a rotating shaft of the rotary electrical component and a rotating shaft of the motor are coaxially integrally formed, and the gear is attached to the rotating shaft.

17. An input apparatus as set forth in claim 16, wherein the motors respectively provided correspondingly to the first and the second driving levers are disposed on a same plane.

18. An input apparatus as set forth in claim 17, wherein at least one of the motors is disposed in a state where an axial line of the motor is positioned one of above and below a position passing a tilt center of the driving body and in a direction perpendicular to the axial line direction.

19. An input apparatus as set forth in claim 18, wherein the motor is disposed in a state where the axial line of the motor is perpendicular to a direction in which the arm extends.

20. An input apparatus as set forth in claim 12, wherein:

the attachment portions are disposed along a plane orthogonal to the axial line direction and are coupled with the lateral face sides of the driving body in the axial line direction, and the arm portions are disposed in a direction perpendicular to the axial line direction.

21. An input apparatus, comprising:

a tiltable operating member;

a driving body having faces, the operating member extending from the driving body in a predetermined direction:

driving levers having attachment portions connected with the faces of the driving body, the driving levers having arm portions that crossover each other without contacting each other, the driving levers having protrusions extending from ends of the arm portions;

shaft support portions connected with the arm portions and around which the driving levers are cantilevered such that the protrusions move in a plane formed by directions of extension of the driving levers when the operating member is tilted;

rotary electrical components detecting motion of the driving levers; and motors connected with the rotary electrical components to provide force feedback to the driving levers.

22. An input apparatus as set forth in claim 21, wherein the protrusions are arc shaped.

23. An input apparatus as set forth in claim 21, wherein the driving body comprises overlapping driving bodies rotatably attached to the operating member, the driving bodies have L shapes extending in orthogonal directions, and each attachment portion is connected with one of the driving bodies.

24. An input apparatus as set forth in claim 21, wherein at least one of the motors does not contact a support plate on which the shaft support portions are mounted.

25. An input apparatus as set forth in claim 21, wherein the driving levers are mounted to the driving body using shaft portions and a center of at least one of the motors is more distal to a support plate on which the shaft support portions are mounted than a plane passing through a center of the shaft portions that is parallel to the support plate.

26. An input apparatus as set forth in claim 21, wherein the driving levers are mounted to the driving body using shaft portions and a center of at least one of the motors is more proximate to a support plate on which the shaft support portions are mounted than a plane passing through a center of the shaft portions that is parallel to the support plate.

27. An input apparatus as set forth in claim 21, wherein at least one of the driving levers is L shaped when viewed in the predetermined direction.

28. An input apparatus as set forth in claim 27, wherein the attachment portion of the at least one of the driving members is orthogonal to the arm portion of the at least one of the driving members, thereby forming the L shape.

29. An input apparatus as set forth in claim 27, wherein the arm portion of the at least one of the driving members contains a first portion extending parallel with the attachment portion of the at least one of the driving members and a second portion from which the protrusion of the at least one of the driving members extends and that is orthogonal to the first portion of the at least one of the driving members, thereby forming the L shape.

30. An input apparatus as set forth in claim 21, wherein the rotary electrical components contain engaging portions that engage with the protrusions.

31. An input apparatus as set forth in claim 30, wherein the engaging portions contain gears and the protrusions contain tooth portions engaging with the gears.

32. An input apparatus as set forth in claim 21, wherein the attachment portions, arm portions, and protrusions of the driving levers form substantial hook shapes.

33. An input apparatus as set forth in claim 21, wherein the arm portions extend from the attachment portions in directions orthogonal to the predetermined direction.

* * * * *